US007333752B2

(12) United States Patent
Kawahara et al.

(10) Patent No.: US 7,333,752 B2
(45) Date of Patent: Feb. 19, 2008

(54) ELECTROPHOTOGRAPHIC PHOTOSENSITIVE MEMBER, AND PROCESS CARTRIDGE AND ELECTROPHOTOGRAPHIC APPARATUS WHICH HAVE THE ELECTROPHOTOGRAPHIC PHOTOSENSITIVE MEMBER

(75) Inventors: Masataka Kawahara, Mishima (JP); Masato Tanaka, Tagata-gun (JP); Atsushi Fujii, Yokohama (JP); Yuka Ishizuka, Sunto-gun (JP); Masaki Nonaka, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/481,840

(22) Filed: Jul. 7, 2006

(65) Prior Publication Data

US 2007/0003851 A1 Jan. 4, 2007

Related U.S. Application Data

(63) Continuation of application No. PCT/JP2006/307794, filed on Apr. 6, 2006.

(30) Foreign Application Priority Data

Apr. 8, 2005 (JP) ..... 2005-111828

(51) Int. Cl.
*G03G 15/00* (2006.01)
*G03G 5/047* (2006.01)

(52) U.S. Cl. ..... 399/159; 430/59.1; 430/59.2; 430/59.4; 430/62

(58) Field of Classification Search ..... 430/59.1, 430/59.2, 59.4, 60, 62, 63, 64, 65; 399/116, 399/159

See application file for complete search history.

(56) References Cited

U.S. PATENT DOCUMENTS

| | | | | |
|---|---|---|---|---|
| 4,618,552 | A | 10/1986 | Tanaka et al. | 430/60 |
| 5,139,907 | A | 8/1992 | Simpson et al. | |
| 6,190,811 | B1 | 2/2001 | Tanaka et al. | 430/78 |
| 2003/0096180 | A1 | 5/2003 | Kizaki et al. | 430/60 |
| 2004/0023139 | A1* | 2/2004 | Yoshimura et al. | 430/59.6 |
| 2005/0111880 | A1* | 5/2005 | Fujii et al. | 399/159 |
| 2006/0234146 | A1* | 10/2006 | Miki et al. | 430/63 |

FOREIGN PATENT DOCUMENTS

| | | |
|---|---|---|
| JP | 01/169453 | 7/1989 |
| JP | 03/146958 | 6/1991 |
| JP | 08/062879 | 3/1996 |
| JP | 2000-347433 | 12/2000 |
| JP | 2001/066813 | 3/2001 |
| JP | 2002/055463 | 2/2002 |
| JP | 2003/021919 | 1/2003 |

(Continued)

*Primary Examiner*—Janis L. Dote
(74) *Attorney, Agent, or Firm*—Fitzpatrick, Cella, Harper & Scinto

(57) ABSTRACT

An electrophotographic apparatus is disclosed using an electrophotographic photosensitive member which employs light with a short wavelength (380 nm to 500 nm) as image exposure light and is good in photoelectric conversion efficiency on the whole at that wavelength. The electrophotographic photosensitive member is composed of a reflecting layer, a charge generation layer and a charge transport layer formed on a support. The total reflectance and specular reflectance of the reflecting layer are 30% or more (with respect to a standard white board) and less than 15%, respectively, at that short-wavelength light. The absorbance of the charge generation layer is 1.0 or less at that short-wavelength light.

7 Claims, 4 Drawing Sheets

FOREIGN PATENT DOCUMENTS

| | | |
|---|---|---|
| JP | 2004/093795 | 3/2004 |
| JP | 2004/151519 | 5/2004 |
| JP | 2005/043763 | 2/2005 |
| JP | 2005/055818 | 3/2005 |
| JP | 2005/070648 | 3/2005 |

* cited by examiner

ELECTROPHOTOGRAPHIC PHOTOSENSITIVE MEMBER, AND PROCESS CARTRIDGE AND ELECTROPHOTOGRAPHIC APPARATUS WHICH HAVE THE ELECTROPHOTOGRAPHIC PHOTOSENSITIVE MEMBER

This application is a continuation of International Application No. PCT/JP2006/307794, filed Apr. 6, 2006, which claims the benefit of Japanese Patent Application No. 2005-111828 filed Apr. 8, 2005.

BACKGROUND OF THE INVENTION

1. Field of the Invention

This invention relates to an electrophotographic photosensitive member having a specific photosensitive layer (inclusive of a charge generation layer and a charge transport layer) and a reflecting layer, and a process cartridge and an image forming apparatus having the electrophotographic photosensitive member.

2. Description of Related Art

In recent years, in order to improve the quality of images output from electrophotographic apparatus, development directed to higher resolution has been increasingly promoted. Measures applied to the apparatus for this end are relatively easy from the aspect of optics. More specifically, an increase in resolution can be achieved by reducing the spot diameter of a laser beam and increasing writing density. However, with semiconductor lasers of approximately from 630 nm to 780 nm in lasing wavelength (emission wavelength) which are conventionally used as light sources, it has been found that the sharpness of spot contours is difficult to attain in some cases even if the spot diameter of a laser beam is reduced by operation of an optical system. This is due to the diffraction limit of a laser beam, and is for the reason that the lower limit (D) of the spot diameter is directly proportional to the emission wavelength λ of a laser beam, as represented by the following equation:

$$D=1.22\lambda/NA$$

wherein NA represents the numerical aperture of a lens.

In electrophotographic processes, red laser beams conventionally commonly used as image exposure light have emission wavelengths as long as approximately from 630 to 780 nm. Hence, as is clear from the above equation, it is difficult to reduce the beam spot diameter beyond a certain extent. This brings about a problem in that the recording density on a photosensitive member can not be increased beyond a certain extent. To cope with this problem, it is necessary to shorten the lasing wavelength of a semiconductor laser.

To shorten lasing wavelengths of lasers, some techniques have been known in the art.

One of them is a technique in which a non-linear optical material is utilized and the emission wavelength of a laser beam is halved by second harmonic generation (SHG) (see, e.g., Japanese Patent Applications Laid-open No. H09-275242, No. H09-189930 and No. H05-313033). In this technique, GaAs LDs and YAG lasers, which have been already established as a technique capable of emitting high-power light, can be used as a primary light source, hence long life and high output can be ensured.

Another is a technique in which a wide-gap semiconductor is used, and an apparatus can be miniaturized as compared with devices using the SHG. LDs using ZnSe semiconductors (see, e.g., Japanese Patent Applications Laid-open No. H07-321409 and No. H06-334272) or LDs using GaN semiconductors (see, e.g., Japanese Patent Applications Laid-open No. H08-88441 and No. H07-335975) have been subjects of research for a long time for the reason that they are high in emission efficiency.

However, it is difficult for these LDs to be optimized in respect of their device structure, crystal-growth conditions, electrodes and so forth, and because of defects or the like in crystals, it has been difficult to perform long-time oscillation at room temperature, which is essential for them to be put into practical use. However, with progress of technological innovation on substrates and so forth, Nichia Corporation reported in October, 1997, that an LD using a GaN semiconductor allowed for continuous oscillation for 1,150 hours (at 50° C.), and started to sell the LD from October, 1997.

Where latent images are formed on a multi-layer type electrophotographic photosensitive member by using laser beams, there has been such a problem that interference fringes tend to appear when the photosensitive member has a charge generation layer having small absorbance at the emission wavelengths of the laser beams. However, in order to increase the absorbance, if the charge generation layer is made too thick, it tends to lower dark-area potential or bring about ghosts. Accordingly, as a method for resolving such a problem, it is proposed that a reflecting layer having the function of erasing the coherence of laser beams is provided between a support and a photosensitive layer (see Japanese Patent No. 2502286).

SUMMARY OF THE INVENTION

However, the reflection efficiency of the reflecting layer of a multi-layer type electrophotographic photosensitive member hitherto put on the market has not been necessarily uniform in the whole visible-light region. In particular, there has been such a problem that where the short wavelength light of GaN semiconductor lasers is used as exposure light, the absorption of the exposure light in the reflecting layer is so large as to lower the photoelectric conversion efficiency of the photosensitive member as a whole.

As a result of exhaustive studies made in order to resolve the above problem, the present inventors have discovered that when using light with a short wavelength (380 nm to 500 nm) (e.g., semiconductor laser beams) as exposure light, an electrophotographic apparatus can form images free of interference fringes and ghosts, having an electrophotographic photosensitive member which has a support, and at least a reflecting layer, a charge generation layer and a charge transport layer provided on the support, wherein the charge generation layer has an absorbance of 1.0 or less at a wavelength of from 380 nm to 500 nm, and the reflecting layer has a total reflectance of 30% or more with respect to a standard white board at that wavelength, and a specular reflectance of less than 15% at that wavelength.

Thus, an objective of the present invention is to provide an electrophotographic apparatus having the following features.

(1) An electrophotographic apparatus having at least an electrophotographic photosensitive member, a charging means, an image exposure means, a developing means and a transfer means, wherein a semiconductor laser having an emission wavelength of from 380 nm to 500 nm is used as the image exposure means; and an electrophotographic photosensitive member having a support, and at least a reflecting layer, a charge generation layer and a charge transport layer provided on the support is used as the electrophotographic photosensitive member, where the reflecting layer has a total reflectance of 30% or more with respect to a standard white board at said emission wavelength and a specular reflectance of less than 15% at said emission wavelength, and the charge generation layer has an absorbance of 1.0 or less at said emission wavelength.

(2) The electrophotographic apparatus described in the above (1), wherein the reflecting layer contains a binder resin having a yellowness index of 15 or less.

(3) The electrophotographic apparatus described in the above (2), wherein the binder resin is an organosilicon type polymer.

(4) The electrophotographic apparatus described in the above (2), wherein the binder resin is a cured product of a phenolic compound represented by the following general formula (1):

(1)

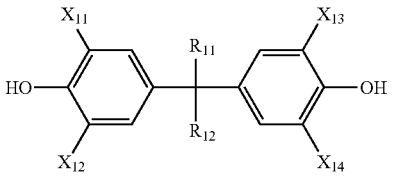

wherein $R_{11}$ and $R_{12}$ are each independently a hydrogen atom, a substituted or unsubstituted alkyl group or a substituted or unsubstituted phenyl group; and $X_{11}$ to $X_{14}$ are each independently a hydrogen atom, a hydroxymethyl group or a methyl group, provided that at least one of $X_{11}$ to $X_{14}$ is a hydroxymethyl group.

(5) The electrophotographic apparatus described in the above (1), wherein the charge generation layer contains a hydroxygallium phthalocyanine compound.

(6) The electrophotographic apparatus described in the feature (1), wherein the charge generation layer contains an azo compound represented by the following general formula (2):

(2)

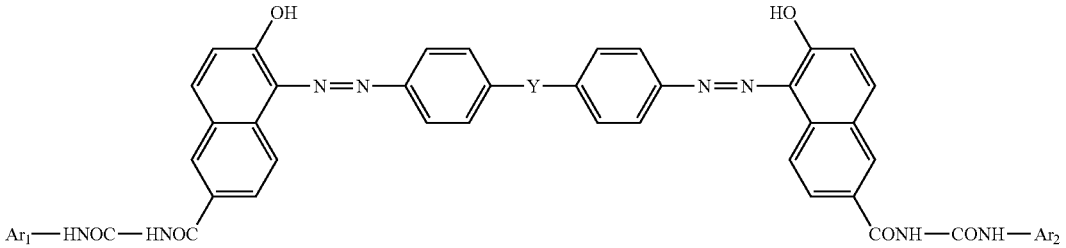

wherein $Ar_1$ and $Ar_2$ are each independently an aryl group which may have a substituent, and Y is a ketone group or a group represented by the following general formula (3) or the following general formula (4):

(3)

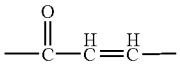

(4)

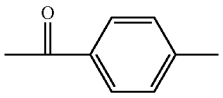

(7) The electrophotographic apparatus described in the above (1), wherein the charge transport layer has an absorbance of 0.05 or less at said emission wavelength.

(8) The electrophotographic apparatus described in the above (1), wherein the charge generation layer has an absorbance of 0.30 or less at said emission wavelength.

Another objective of the present invention is to provide an electrophotographic photosensitive member having a support, and at least a reflecting layer, a charge generation layer and a charge transport layer provided on the support, wherein the reflecting layer contains a cured product of the phenolic compound represented by the above general formula (1).

A further objective of the present invention is to provide a process cartridge having the above electrophotographic photosensitive member and at least one means selected from the group consisting of a charging means, a developing means and a cleaning means, which are integrally supported, and being detachably mountable to the main body of an electrophotographic apparatus.

According to the present invention, the electrophotographic apparatus can be provided which uses light with a short wavelength (380 nm to 500 nm) as exposure light, and the electrophotographic photosensitive member having a support and the specific reflecting layer and the photosensitive layer (charge generation layer and charge transport layer) provided on the support, is superior in photoelectric conversion efficiency as a whole, and can form images free of interference fringes and ghosts.

Figure 1:
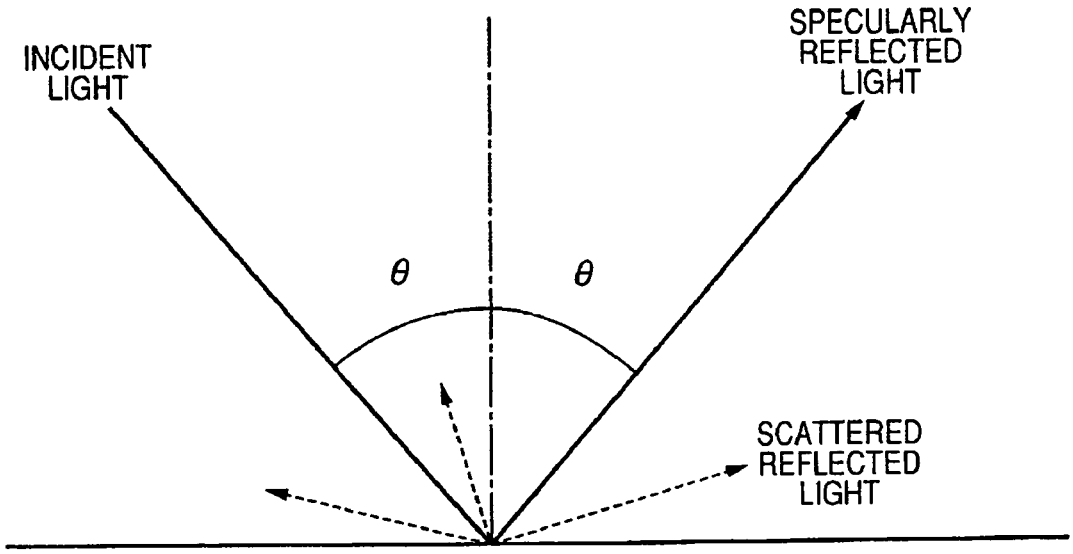
FIG. 1 is a conceptual view showing optical characteristics of the reflecting layer in the present invention.

Each reference numeral denotes:

21: support;
22: reflecting layer;
23: intermediate layer;
24: charge generation layer;
25; charge transport layer;
1: electrophotographic photosensitive member of the present invention;
2: shaft;
3: primary charging means;
4: exposure light;
5: developing means;
6: transfer means;

7: transfer material;
8: image fixing means;
9: cleaning means;
10: pre-exposure light;
11: process cartridge; and
12: rail.

DESCRIPTION OF THE PREFERRED EMBODIMENTS

The present invention is described below in detail.

-Electrophotographic Photosensitive Member of the Invention-

Figure 2:
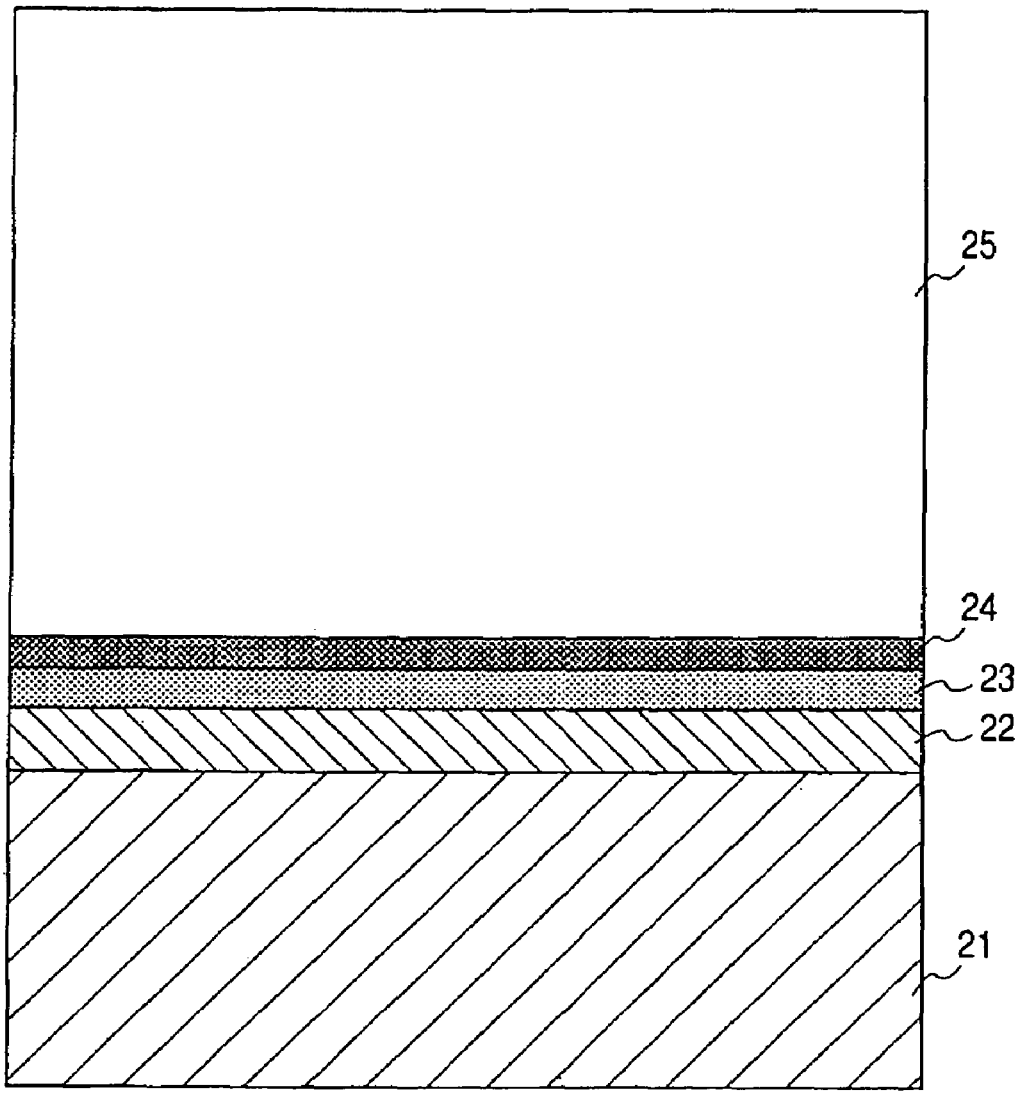
FIG. 2 is a schematic view showing the layer constitution of the photosensitive member of the present invention.

The electrophotographic photosensitive member of the present invention has a support, a reflecting layer and a photosensitive layer (inclusive of a charge generation layer and a charge transport layer). Preferably, the reflecting layer, the charge generation layer and the charge transport layer are superposed in this order on the support. More specifically, it is preferable that the reflecting layer is provided between the support and the photosensitive layer. The electrophotographic photosensitive member of the present invention may further have an optional layer(s). In particular, it may preferably have an intermediate layer between the reflecting layer and the photosensitive layer (preferably the charge generation layer), and may further have a surface protective layer. Preferable constitution of the electrophotographic photosensitive member in the present invention is schematically shown in FIG. 2.

The electrophotographic photosensitive member is imagewise exposed to light, where the exposure light may preferably have a wavelength of from 380 nm to 500 nm. The exposure light may further preferably be a semiconductor laser beam having an emission wavelength of from 380 nm to 500 nm. The use of the semiconductor laser beam having an emission short-wavelength of from 380 nm to 500 nm can remarkably bring out the characteristic features of the electrophotographic photosensitive member of the present invention. The reason therefor is that even though image exposure is performed using a short-wavelength laser, the absorption of image exposure light in the reflecting layer can be controlled, thereby effectively bringing out the effect of the present invention such that the photoelectric conversion efficiency of the photosensitive member as a whole can be improved.

The support (e.g., what is denoted by 21 in FIG. 2) of the electrophotographic photosensitive member of the present invention may preferably be one having conductivity (a conductive support). For example, it is possible to use supports made of a metal such as aluminum, an aluminum alloy, or stainless steel. Where the support is a non-conductive support, the electrophotographic photosensitive member must be so set up as to be grounded from its reflecting layer.

In the case where the support is made of aluminum or an aluminum alloy, it is possible to use an ED pipe and an EI pipe, or those obtained by subjecting these pipes to cutting, electrolytic composite polishing (electrolysis carried out using i) an electrode having electrolytic action and ii) an electrolytic solution, and polishing carried out using a grinding stone having polishing action) or wet-process or dry-process honing. Besides, it is possible to use the above supports made of metal, or supports made of resin (such as polyethylene terephthalate, polybutylene terephthalate, phenolic resin, polypropylene, or polystyrene resin), having a layer formed by vacuum deposition of aluminum, an aluminum alloy, an indium oxide-tin oxide alloy, etc. In addition, it is possible to use supports made of resin or paper impregnated with conductive particles such as carbon black, tin oxide particles, titanium oxide particles or silver particles, and supports made of plastic containing a conductive binder resin. The support may have any shape such as the shape of a drum, e.g., a cylindrical shape or a columnar shape, the shape of a sheet and the shape of a belt.

The support may preferably have a ten-point average roughness (Rz jis) of from 0.1 to 5 μm. In the present specification, the Rz jis refers to the value measured according to JIS B 0601 (1994).

As mentioned previously, it is preferable that the electrophotographic photosensitive member of the present invention is provided with the reflecting layer (e.g., 22 in FIG. 2) between the support and the photosensitive layer.

The reflecting layer contains a binder resin, and particles dispersed therein (dispersed particles) having a refractive index different from the binder resin. The reflecting layer may further contain other optional component(s). For example, it may contain a surface roughening material and a leveling agent.

The dispersed particles contained in the reflecting layer may preferably be conductive particles. The reflecting layer is required to have conductivity, and may be made conductive by using conductive particles as the dispersed particles. As the conductive particles, it is preferable to use titanium oxide particles coated with tin oxide containing antimony, and titanium oxide particles coated with tin oxide whose resistance is lowered by creating oxygen deficient.

The dispersed particles (preferably the conductive particles) may preferably have an average particle diameter of from 0.1 to 2 μm. The average particle diameter is the particle diameter measured according to the liquid-phase sedimentation method. Specifically, a reflecting layer coating fluid is diluted with a solvent used therefor, and the average particle diameter is measured with an ultra-centrifugal automatic particle size distribution measuring instrument (CAPA 700) manufactured by Horiba Ltd.

The dispersed particles (preferably the conductive particles) in the reflecting layer may be preferably in an amount 1 to 10 times, and more preferably 2.5 to 6 times, the mass of the binder resin.

The binder resin used in the reflecting layer of the electrophotographic photosensitive member of the present invention may preferably include, e.g., silicone resins, phenolic resins, polyurethanes, polyamides, polyimides, polyamide-imides, polyamic acids, polyvinyl acetal, epoxy resins, acrylic resins, melamine resins, and polyesters. These resins have good adherence to the support. At the same time, it can improve the dispersibility of filler used in the reflecting layer of the photosensitive member of the present invention, and has good solvent resistance after film formation. Any of these resins may be used alone or in combination.

The binder resin used in the reflecting layer in the present invention has a yellowness index of preferably 15 or less, and more preferably 10 or less. The reason therfor is that the total reflectance of the reflecting layer with respect to the semiconductor laser beam having an emission wavelength of from 380 nm to 500 nm, which is image exposure light with which the electrophotographic photosensitive member of the present invention is irradiated, can be improved. The yellowness index may be measured with, e.g., SZ-Σ90, manufactured by Nippon Denshoku Industries Co., Ltd., or CM3630, manufactured by Konica Minolta Holding, Inc., according to JIS Z 8722.

Even in the case of a spectrocolorimeter on which no yellowness index is displayed, a measuring instrument which can find CIE-XYZ tristimulus values, using a standard light source C (north sky light), e.g., SPECTROLINO, manufactured by Gretag-Macbeth Holding Ag, may be used to find the XYZ values, and the yellowness index (YI) may be calculated according to the following equation as defined in ASTM D 1925:

$$YI=[100(1.28X-1.06Z)]/Y.$$

The yellowness index of the binder resin in the present invention may be found in the following way: A transparent support for reference (e.g., PET film slide glass of 125 μm in layer thickness) is coated with a resin to be measured in a layer thickness of 10 μm. This is placed on a standard white board, and the YI value is measured according to the above method. A reference value (a YI value obtained by measuring only the transparent support for reference according to the same method) is subtracted from the above obtained value.

Among resins the yellowness indexes of which are 15 or less, what may preferably be used is a resin which is a cured product of a phenolic compound represented by the following general formula (1). This resin is small in tint variation due to deterioration by oxidation, and hence a reduction in the total reflectance of the reflecting layer is small even when the photosensitive member having the reflecting layer formed using this resin as the binder resin is used over a long period of time.

(1)

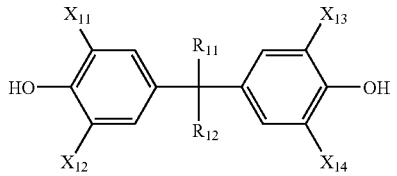

In the general formula (1), $R_{11}$ and $R_{12}$ are each independently a hydrogen atom, a substituted or unsubstituted alkyl group or a substituted or unsubstituted phenyl group; and $X_{11}$ to $X_{14}$ are each independently a hydrogen atom, a hydroxymethyl group or a methyl group, provided that at least one of $X_{11}$ to $X_{14}$ is a hydroxymethyl group.

The substituents on the alkyl group or phenyl group represented by $R_{11}$ and $R_{12}$ may include alkyl groups such as a methyl group, an ethyl group, a propyl group and a butyl group; aryl groups such as a phenyl group, a biphenyl group and a naphthyl group; halogen atoms such as a fluorine atom, a chlorine atom and a bromine atom; and halomethyl groups such as a trifluoromethyl group and a tribromomethyl group.

As preferred $R_{11}$ and $R_{12}$, the following may be specifically cited: a hydrogen atom, a methyl group, and halomethyl groups such as a trifluoromethyl group and a tribromomethyl group.

Examples of the compound of the general formula (1) as used in the present invention are shown in Table 1 below. The compound of the general formula (1) is by no means limited to these.

TABLE 1

| Exemplary Compound | $R_{11}$ | $R_{12}$ | $X_{11}$ | $X_{12}$ | $X_{13}$ | $X_{14}$ |
|---|---|---|---|---|---|---|
| (1-1) | H | H | —$CH_2OH$ | H | H | —$CH_2OH$ |
| (1-2) | H | $CH_3$ | H | —$CH_2OH$ | —$CH_2OH$ | H |
| (1-3) | $CH_3$ | $CH_3$ | —$CH_2OH$ | H | —$CH_2OH$ | H |
| (1-4) | $CH_3$ | $CH_3$ | —$CH_2OH$ | —$CH_2OH$ | —$CH_2OH$ | —$CH_2OH$ |
| (1-5) | $CH_3$ | $CH_3$ | —$CH_2OH$ | $CH_3$ | $CH_3$ | —$CH_2OH$ |
| (1-6) | $CF_3$ | $CF_3$ | —$CH_2OH$ | H | —$CH_2OH$ | H |

TABLE 1-continued

| Exemplary Compound | $R_{11}$ | $R_{12}$ | $X_{11}$ | $X_{12}$ | $X_{13}$ | $X_{14}$ |
|---|---|---|---|---|---|---|
| (1-7) | $CF_3$ | $CF_3$ | —$CH_2OH$ | —$CH_2OH$ | —$CH_2OH$ | —$CH_2OH$ |
| (1-8) | $CF_3$ | $CF_3$ | —$CH_2OH$ | $CH_3$ | —$CH_2OH$ | $CH_3$ |

The cured product of the phenolic compound represented by the above general formula (1) refers to one in which the phenolic compound has reacted by condensation reaction, addition reaction or similar reaction in virtue of its functional groups (inclusive of hydroxyl groups or hydroxymethyl groups) to form three-dimensional polymeric networks. For example, it is what is obtained by dispersing the phenolic compound in an organic solvent, followed by heat treatment and then drying to effect heat curing.

As the organosilicon type polymer which is the binder resin of the reflecting layer, the following may be cited: e.g., hydrolysis condensation products of polysiloxanes such as organopolysiloxanes, polysilalkylenesiloxanes and polysilarylenesiloxanes. In such polysiloxanes, the ratio of the number of the monovalent hydrocarbon groups bonded to silicon atoms to the number of the silicon atoms may preferably be from 0.5 to 1.5. When controlling the ratio of the number of the monovalent hydrocarbon groups bonded to silicon atoms to the number of the silicon atoms within such a ratio range, it can be prevented that the composition of the hydrolysis condensation product is close to the composition of glass and it is difficult for the hydrolysis condensation product to form a film, or the property of the hydrolysis condensation product becomes too rubbery and its hardness is lowered.

As the organopolysiloxane, it may preferably be one having a structural unit represented by the following general formula (5):

$$R^{21}_{r}SiO_{(4-rs)/2}(OR^{22})_{s} \quad (5)$$

wherein $R^{21}$ represents a straight-chain or branched alkyl group, an alkenyl group or an aryl group; $R^{22}$ represents a hydrogen atom or an alkyl group; and r and s each represent a molar ratio.

In the above general formula (5), it is preferable that $R^{21}$ is a monovalent hydrocarbon group bonded to the silicon atom and has 1 to 18 carbon atoms. The straight-chain or branched alkyl group represented by $R^{21}$ may include, e.g., a methyl group, an ethyl group, a propyl group, a butyl group, a pentyl group, a hexyl group, a 2-ethylhexyl group, a dodecyl group and an octadecyl group, and the alkenyl group may include, e.g., a vinyl group and an allyl group. The aryl group may include, e.g., a phenyl group and a tolyl group. $R^{21}$ may further be, e.g., a fluorohydrocarbon group as typified by a trifluoropropyl group, a heptafluoropentyl group and a nonafluorohexyl group; a chlorohydrocarbon group such as a chloromethyl group and a chloroethyl group; and a straight-chain or branched, saturated hydrocarbon substituted with a halogen.

$R^{21}$ is not necessarily required to be of a single type, and may appropriately be selected in accordance with the improvement of resin properties, the improvement of solubility in solvents, etc. It is a well known fact that in a system in which a methyl group and a phenyl group are present together, the affinity for organic compounds is commonly further improved than in a system in which the methyl group is present alone. Where the fluorohydrocarbon group is introduced, even the organopolysiloxane is reduced in surface tension in virtue of the effect brought about by fluorine atoms as in the case of common polymers, and hence the organopolysiloxane changes in properties such as water repellency and oil repellency. In the present invention as well, where lower surface tension is required, an organopolysiloxane may be used in which silicon units bonded to the fluorohydrocarbon group have been introduced by copolymerization.

The letter symbol r represents a molar ratio, and may preferably be from 0.5 to 1.5 on the average.

The $OR^{22}$ group bonded to the silicon atom in the above general formula (5) is a hydroxyl group or a group capable of undergoing hydrolysis condensation. $R^{22}$ is selected from a hydrogen atom and lower alkyl groups such as a methyl group, an ethyl group, a propyl group and a butyl group. The reactivity of $R^{22}$ in the $OR^{22}$ group is highest when $R^{22}$ is hydrogen, and is lowered with an increase in the number of carbon atoms when $R^{22}$ is alkyl, and may appropriately be selected in accordance with a reaction system to be used. The ratio of groups capable of undergoing hydrolysis condensation is represented by s, and may preferably be 0.01 or more. It is well known that hardness of a cured resin is adjustable by controlling cross-link density. Also in the organosilicon type polymer used in the present invention, controlling the number of groups which are bonded to silicon atoms of the polysiloxane to be cured and are capable of undergoing hydrolysis condensation, it is possible to adjust the hardness of the resin (the binder resin which is the organosilicon type polymer). However, if groups capable of undergoing hydrolysis condensation are too many, there is a possibility that part of the groups remain unreacted and are hydrolyzed in a service environment to adversely affect surface properties and so forth.

Accordingly, a preferred value of s is from 0.01 to 1.5.

When obtaining the organosilicon type polymer which is the hydrolysis condensation product of the polysiloxane, a cross-linking agent may be added to effect cross-linking through the agent. As the cross-linking agent, a silane compound may be used which is represented by the following general formula (6), whereby it is easy to control physical properties such as hardness and strength of a surface protective layer formed by curing a curable composition.

$$R^{31}_{a}SiY_{1-n} \quad (6)$$

wherein $R^{31}$ represents a straight-chain or branched alkyl group, an alkenyl group or an aryl group; Y represents a hydrolyzable group; and a represents a molar ratio.

In the general formula (6), $R^{31}$ may preferably be a group having 1 to 18 carbon atoms, and may include, e.g., a methyl group, an ethyl group, a propyl group, a butyl group, an amyl group, a hexyl group, a vinyl group, an allyl group, a phenyl group and a tolyl group. The hydrolyzable group represented by Y may include a hydrogen atom, a methoxyl group, an ethoxyl group, a methyl ethyl ketoxime group, a diethylamino group, an acetoxyl group, a propenoxyl group, a propoxyl group, and a butoxyl group.

As specific examples of the silane compound represented by the general formula (6), serving as the cross-linking agent, it may include, e.g., methyltrimethoxysilane, methyltriethoxysilane, vinyltrimethoxysilane, phenyltriethoxysilane, and silanes in which the alkoxyl group of the above has been replaced with an acetoxyl group, a methyl ethyl ketoxime group, a diethylamino group or an isopropenoxyl group. The cross-linking agent may be in the form of an oligomer, such as an ethyl polysilicate.

For the hydrolysis and condensation of the polysiloxane, it is not necessarily required to use a catalyst, but is not precluded to use a catalyst used for curing usual organopolysiloxanes. Such a catalyst may appropriately be selected from alkyltin organic acid salts such as dibutyltin diacetate, dibutyltin diraulate and dibutyltin octoate (octanoate), or organic titanic acid esters such as n-butyl titanate, taking into account time necessary for curing, curing temperature and so forth.

Processes for producing polysiloxanes usable in the present invention include processes disclosed in Japanese Patent Publications No. S26-2696 and No. S28-6297, as well as the process for synthesizing organopolysiloxanes that is disclosed in Chemistry and Technology of Silicones, Chapter 5, p. 191 ff. (Walter Noll, Academic Press, Inc., 1968). For example, an organopolysiloxane is synthesized by dissolving in an organic solvent an organoalkoxysilane or organohalogenosilane in which the number r of monovalent organic groups is from 0.5 to 1.5 on the average based on the number of silicon atoms, and subjecting it to hydrolysis and condensation in the presence of an acid or a base to effect polymerization, followed by removal of the solvent. The polysiloxane used in the present invention is used in the state it is dissolved in a solvent including aromatic hydrocarbons such as toluene and xylene, aliphatic hydrocarbons such as cyclohexanone and hexane, halogen-containing hydrocarbons such as chloroform and chlorobenzene, and alcohols such as ethanol and butanol.

The reflecting layer may further optionally contain an irregular reflection material (or a material for creating irregular reflection) in order to lessen the specular reflectance. The irregular reflection material may include, e.g., silicon resin particles and metal oxide particles. The irregular reflection material particles may preferably have a particle diameter of from 0.1 to 5 μm. The irregular reflection material may preferably be in a content of from 5 to 90% by mass based on the total mass of the reflecting layer.

The reflecting layer of the photosensitive member of the present invention may be formed on the support by coating the support surface with a dispersion prepared by dispersing the binder resin or a monomer which is a raw-material of the binder resin [e.g., the phenolic compound represented by the general formula (1)], a surface roughening material and optionally a leveling agent in an organic solvent (e.g., methoxypropanol), followed by drying and heat curing. Here, as methods for coating, any conventionally known methods may be used, such as dip coating, spray coating and bar coating.

The total reflectance of the reflecting layer in the present invention is preferably 30% or more, and more preferably 50% or more, with respect to a standard white board at the wavelength of from 380 nm to 500 nm. On the other hand, it is preferable that the total reflectance is 100% or less as a standard. In the reflecting layer of a particle dispersion type, a reasonable layer thickness is necessary for increasing the total reflectance. Specifically, it is preferable that the layer thickness of the reflecting layer is from 3 μm to 30 μm, and more preferably from 4 μm to 15 μm.

In the present invention, the total reflectance of the reflecting layer refers to a value found by dividing the intensity of reflected light with respect to the total space by the intensity of incident light. In the present invention, the intensity of reflected light with respect to the total space may be measured in the following way.

On a sheet having the same components as the support, a film having the same components as the reflecting layer and having the same layer thickness as the reflecting layer is formed in the same procedure as the procedure for forming the reflecting layer on the support. The sheet on which the film has been formed is used as a measurement sample, and an integrating sphere unit is set in a spectrophotometer U-3300, manufactured by Hitachi Ltd., where the intensity of reflected light with respect to the total space can be measured.

The layer thickness of the reflecting layer of the photosensitive member of the present invention may be measured according to JIS K 5600-1-7. The layer thickness of each of the layers (e.g., the charge generation layer, the charge transport layer and so forth) the photosensitive member of the the present invention has, may also be measured in the same way.

The reflecting layer may preferably have a specular reflectance of 15% or less at the wavelength of from 380 nm to 500 nm, and more preferably 10% or less, in view of the function of erasing the coherence of semiconductor laser beams. On the other hand, it may preferably have a specular reflectance of 0% or more as a standard. A reduction in the specular reflectance of the reflecting layer can be achieved by incorporating the reflecting layer with the binder resin and the dispersed particles having a refractive index different from the binder resin, as mentioned previously, to allow incident light to disappear in the reflecting layer. The surface of the reflecting layer may be provided with roughness to a certain degree. Specifically, the reflecting layer may preferably have a surface roughness of from 0.1 to 1 μm in ten-point average roughness (Rz jis). The surface roughness of the reflecting layer may be adjusted by using the irregular reflection material particles described above.

In the present invention, the specular reflectance of the reflecting layer refers to a value found when the intensity of reflected light (the intensity of specularly reflected light) reflected at the same angle as the incident angle of image exposure light with respect to a normal line of the surface reflecting the image exposure light is divided by the intensity of incident light. In the present invention, the intensity of specularly reflected light of the exposure light may be measured in the following way.

A measurement sample is prepared in the same way as in the case where the intensity of reflected light with respect to the total space is measured. Using the sample, the intensity of specularly reflected light of the exposure light may be measured with a GONIOPHOTOMETER GP-3, manufactured by OPTEC Co., Ltd. In the present invention, it is preferable that the measurement is carried out using exposure light whose incident angle is 20 degrees with respect to the normal line of the sample surface. A conceptual view of the specularly reflected light is shown in FIG. 1.

As stated previously, the electrophotographic photosensitive member of the present invention has a charge generation layer (e.g., what is denoted by 24 in FIG. 2). The charge generation layer contains a binder resin and a charge generating material, and may further contain other optional components.

The charge generating material to be used in the charge generation layer may include phthalocyanine pigments, polycyclic quinone pigments, trisazo pigments, bisazo pigments, azo pigments, perylene pigments, indigo pigments, quinacridone pigments, azulenium salt dyes, squalium dyes, cyanine dyes, pyrylium dyes, thiopyrylium dyes, xanthene dyes, triphenylmethane dyes, styryl dyes, selenium, selenium-tellurium alloys, amorphous silicon and cadmium sulfide. Of these, any materials may be used which have absorption at the wavelength (preferably 380 nm to 500 nm) of the image exposure light with which the electrophotographic photosensitive member of the present invention is to be irradiated. It is preferable to use azo pigments or phthalocyanine pigments.

As the phthalocyanine pigments, any desired phthalocyanines may be used, such as metal-free phthalocyanine, and a metal phthalocyanine which may have an axial ligand. The phthalocyanine may have a substituent. Particularly preferably, oxytitanium phthalocyanine and gallium phthalocyanine are cited. These phthalocyanine pigments have superior sensitivity, and ghosts do not easily occur in images formed by electrophotographic apparatus using the electrophotographic photosensitive member having such a charge generation layer containing any of the phthalocyanine pigments.

In addition, the phthalocyanine pigments may have any crystal forms. In particular, hydroxygallium phthalocyanine of a crystal form having strong peaks at 7.4°±0.3° and 28.2°±0.3° of Bragg angles 2θ in CuKα characteristic X-ray diffraction is preferable.

The phthalocyanines have especially superior sensitivity characteristics, whereas it tends to bring about ghosts due to long-term running if the charge generation layer has a large thickness. Accordingly, the present invention may especially effectively act.

As the azo pigments, any desired azo pigments may be used, such as bisazo, trisazo and tetrakisazo pigments. However, an azo pigment represented by the following general formula (2) has superior sensitivity characteristics, whereas it tends to bring about interference fringes because of its low absorbance per unit layer thickness. Therefore, the feature of the present invention in which a reflecting layer is provided having the function of erasing the coherence of exposure light laser beams, can especially effectively act.

(2)

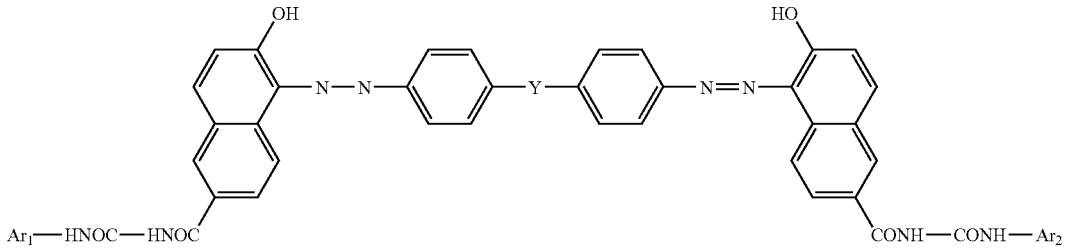

wherein $Ar_1$ and $Ar_2$ each represent an aryl group which may have a substituent, and Y represents a ketone group or a group represented by the following general formula (3) or the following general formula (4):

(3)

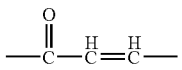

(4)

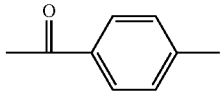

In the above general formula (2), the aryl group may include a phenyl group and a naphthyl group. As the substituent on the aryl group, it may include alkyl groups such as a methyl group, an ethyl group, a propyl group and a butyl group; aryl groups such as a phenyl group, a biphenyl group and a naphthyl group; alkoxyl groups such s a methoxyl group and an ethoxyl group; dialkylamino groups such as a dimethylamino group and a diethylamino group; arylamino groups such as a phenylamino group and a diphenylamino group; halogen atoms such as a fluorine atom, a chlorine atom and a bromine atom; halomethyl groups such as a trifluoromethyl group and a tribromomethyl group; and a hydroxyl group, a nitro group, a cyano group, an acetyl group and a benzoyl group.

Examples of the compound of the general formula (2) as used in the present invention are shown in Table 1 below. The compound of the general formula (2) is by no means limited to these.

TABLE 2

| | Y | Ar1 | Ar2 |
|---|---|---|---|
| Exemplary Compound (2-1) | 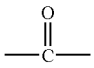 | 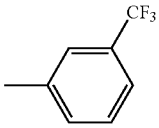 | 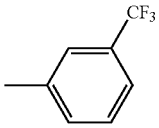 |
| Exemplary Compound (2-2) | 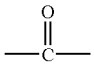 | 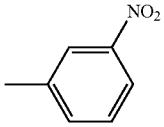 | 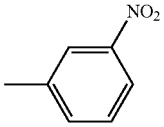 |
| Exemplary Compound (2-3) | 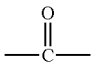 | 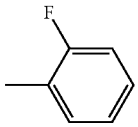 | 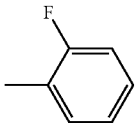 |
| Exemplary Compound (2-4) | 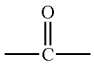 | 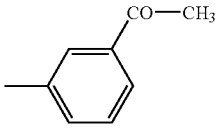 | 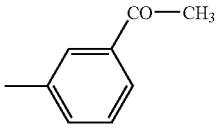 |
| Exemplary Compound (2-5) | 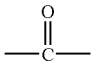 | 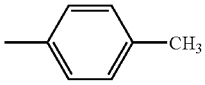 | 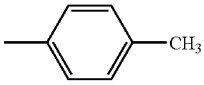 |
| Exemplary Compound (2-6) | 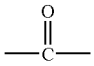 | 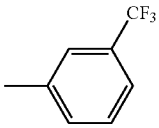 | 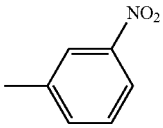 |
| Exemplary Compound (2-7) | 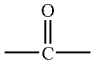 | 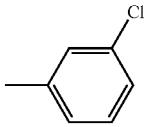 | 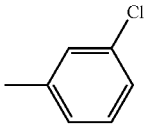 |
| Exemplary Compound (2-8) | 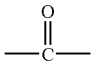 | 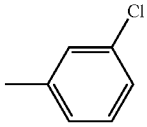 | 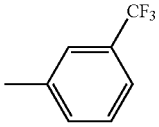 |
| Exemplary Compound (2-9) | 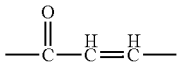 | 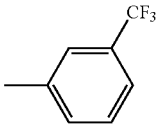 | 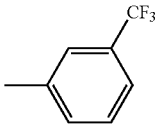 |
| Exemplary Compound (2-10) | 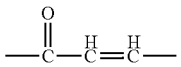 | 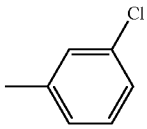 | 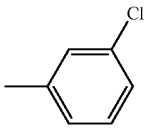 |

TABLE 2-continued

| | Y | Ar1 | Ar2 |
|---|---|---|---|
| Exemplary Compound (2-11) | 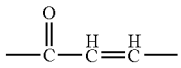 | 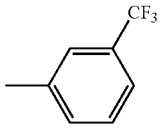 | 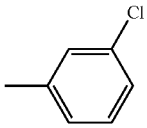 |
| Exemplary Compound (2-12) | 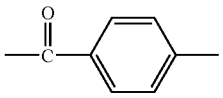 | 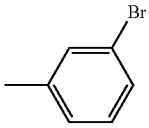 | 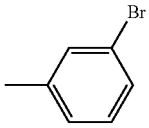 |
| Exemplary Compound (2-13) | 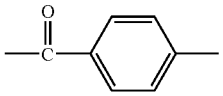 | 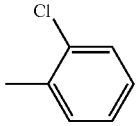 | 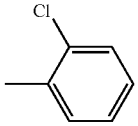 |
| Exemplary Compound (2-14) | 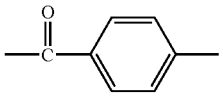 | 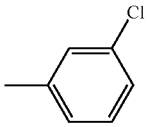 | 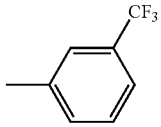 |

The charge generating material in the charge generation layer may preferably be in a content of 20% by mass or more, and more preferably 60% by mass or more, based on the total mass of the charge generation layer.

The binder resin used in the charge generation layer of the electrophotographic photosensitive member of the present invention may be selected from insulating resins or organic photoconductive polymers in a wide range. It is preferable to use polyvinyl butyral, polyvinyl benzal, polyarylates, polycarbonates, polyesters, phenoxy resins, cellulose resins, acrylic resins, and polyurethanes. These resins may have a substituent. As the substituent, a halogen atom, an alkyl group, an alkoxyl group, a nitro group, a cyano group, and a trifluoromethyl group are preferable.

The binder resin in the charge generation layer may preferably be in an amount of 80% by mass or less, and more preferably 40% by mass or less, based on the total mass of the charge generation layer.

The charge generation layer 24 may preferably be a thin film from the viewpoint of charge characteristics. More specifically, the charge generation layer may preferably have a layer thickness of from 0.1 to 2 μm. The smaller the layer thickness of the charge generation layer, the lower the absorbance of the charge generation layer is, and the effect exhibited by the reflecting layer can be more effectively brought about. In the present invention, the charge generation layer may have an absorbance of 1.0 or less, preferably 0.70 or less, and more preferably 0.30 or less. On the other hand, it may preferably have an absorbance of 0.1 or more.

The absorbance (A) of the charge generation layer in the present invention refers to a common logarithm of a value found by dividing the intensity of incident light ($I_0$) by the intensity of transmitted light.

$$A=\log(I_0/I)$$

The absorbance of the charge generation layer of the photosensitive member of the present invention may be measured in the following way.

On a PET (polyethylene terephthalate) film, a film having the same components as the charge generation layer and having the same layer thickness as the charge generation layer is formed in the same procedure as the procedure for forming the charge generation layer in the photosensitive member (preferably on the intermediate layer).

The film formed on the PET film is used as a measurement sample, and the absorbance may be measured with, e.g., a spectrophotometer U-3300, manufactured by Hitachi Ltd.

The charge generation layer may be formed by coating the intermediate layer or reflecting layer with a dispersion prepared by dispersing the charge generating material in a suitable solvent together with the binder resin, followed by drying. Here, as methods for coating, any conventionally known methods may be used, such as dip coating, spray coating and bar coating.

As the solvent used therefor, it may preferably be selected from solvents which are capable of dissolving the binder resin and do not dissolve the charge transport layer and a subbing layer. Specifically, it may include, e.g., ethers such as tetrahydrofuran and 1,4-dioxane, ketones such as cyclohexanone and methyl ethyl ketone, amines such as N,N-dimethylformamide, esters such as methyl acetate and ethyl acetate, aromatics such as toluene, xylene and chlorobenzene, alcohols such as methanol, ethanol and 2-propanol, and aliphatic halogenated hydrocarbons such as chloroform, methylene chloride, dichloroethylene, carbon tetrachloride, and trichloroethylene.

As mentioned previously, the electrophotographic photosensitive member of the present invention has a charge transport layer (e.g., what is denoted by 25 in FIG. 2). The charge transport layer contains a charge transporting material and an insulating binder resin. The charge transporting material and the insulating binder resin may be appropriately selected from known ones and used. For example, the charge transporting material may include arylamine type compounds, aromatic hydrazone type compounds and stilbene type compounds, and the binder resin may include polymethyl methacrylate resins, polystyrene resins, styrene-acrylonitrile copolymer resins, polycarbonate resins, polyarylate resins and diallyl phthalate resins.

The charge transporting material and binder resin contained in the charge transport layer may preferably be in a weight ratio (charge transporting material/binder resin) of from 2/10 to 20/10, and more preferably from 3/10 to 12/10 from the viewpoint of the charge transport performance of the electrophotographic photosensitive member and the strength of the charge transport layer.

The charge transport layer may preferably have a layer thickness of from 5 to 40 μm, and more preferably from 10 to 30 μm.

The charge transport layer has an absorbance of 1.0 or less, and preferably 0.05 or less, for laser beams of from 380 nm to 500 nm in wavelength.

To form the charge transport layer, the charge transporting material and the insulating binder resin may be dissolved in a solvent to prepare a coating solution, and this solution may be applied on the charge generation layer (which may be other layers), followed by drying. Here, as methods for coating, any conventionally known methods may be used, such as dip coating, spray coating and bar coating.

The solvent used in the step of forming the charge transport layer may include chlorobenzene, tetrahydrofuran, 1,4-dioxane, toluene and xylene, which may be used alone or in combination.

As mentioned previously, the electrophotographic photosensitive member of the present invention may have an intermediate layer (e.g., what is denoted by 23 in FIG. 2) between the photosensitive layer and the reflecting layer. Where the intermediate layer is provided, it is possible to improve the adherence between the reflecting layer and the photosensitive layer (e.g., the charge generation layer) and the electrical properties of the photosensitive layer. The intermediate layer may be formed from casein, polyvinyl alcohol, nitrocellulose, polyvinyl butyral, polyester, polyurethane, gelatin, polyamide (nylon 6, nylon 66, nylon 610, copolymer nylon, or alkoxymethylated nylon), aluminum oxide or the like, or a combination of any of these.

It is suitable for the intermediate layer to have a layer thickness of from 0.1 to 10 μm, and preferably from 0.3 to 3 μm.

To form the intermediate layer, the above resins may be dissolved in a solvent to prepare a coating solution, and this solution may be applied on the charge generation layer, followed by drying. Here, as methods for coating, any conventionally known methods may be used, such as dip coating, spray coating and bar coating.

The respective layers described above (such as the reflecting layer, the charge generation layer, the charge transport layer and the intermediate layer) may each be incorporated with, in addition to the above components, an additive or additives in order to improve mechanical properties and enhance durability. Such additives may include an antioxidant, an ultraviolet absorber, a stabilizer, a cross-linking agent, a lubricant and a conductivity control agent.

As the lubricant, it may include fluorine atom-containing resin particles, silica particles and silicone resin particles. The fluorine atom-containing resin particles are preferred. The fluorine atom-containing resin particles may include particles of tetrafluoroethylene resin, trifluorochloroethylene resin, hexafluoroethylene propylene resin, vinyl fluoride resin, vinylidene fluoride resin, difluorodichloroethylene resin and copolymers of these, any one or two or more of which may preferably appropriately be selected. In particular, tetrafluoroethylene resin and vinylidene fluoride resin particles are preferred.

-Electrophotographic Apparatus of the Invention-

Figure 3:
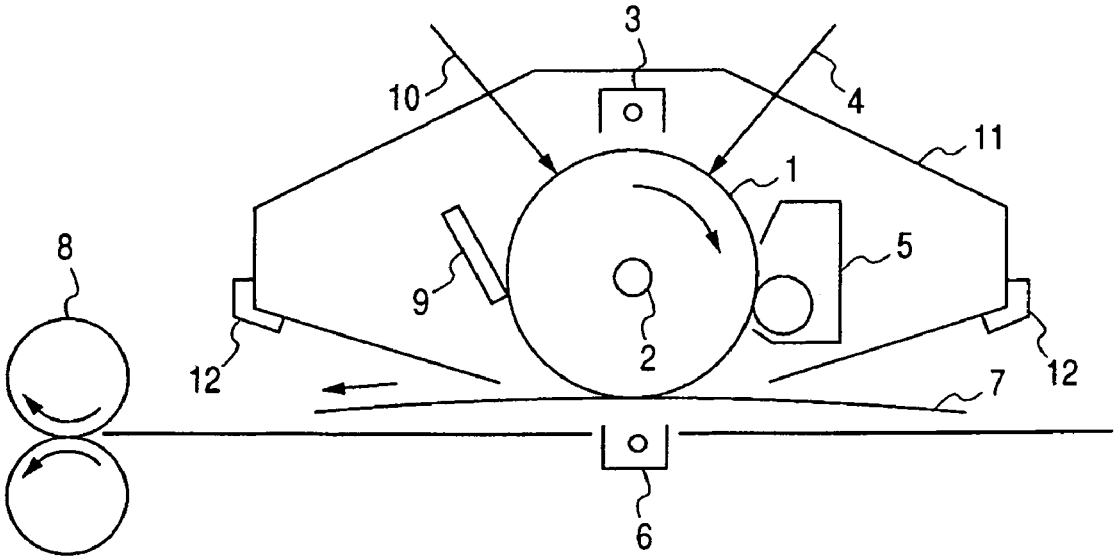
FIG. 3 is a schematic structural view showing an example of the image forming apparatus of the present invention.

FIG. 3 is a schematic sectional view showing an embodiment of the electrophotographic apparatus of the present invention. In FIG. 3, reference numeral 1 denotes a drum-shaped electrophotographic photosensitive member, which is an electrophotographic photosensitive member of the present invention. In FIG. 3, reference numeral 4 denotes image exposure light with which the photosensitive member is irradiated by scanning with semiconductor laser beams having the wavelength of from 380 nm to 500 nm. As members other than those denoted by 1 and 4 in FIG. 3, any desired members may be employed.

As shown in FIG. 3, the electrophotographic photosensitive member 1 is rotatively driven around an axis 2 in the direction of an arrow at a stated peripheral speed. The peripheral surface of the photosensitive member 1 is uniformly charged to a positive or negative, given potential through a primary charging means 3 while being rotated. Then, the electrophotographic photosensitive member thus charged is exposed to the image exposure light 4 emitted from an exposure means (not shown) for scanning laser beam exposure or the like. In this way, electrostatic latent images are successively formed on the peripheral surface of the photosensitive member 1.

The electrostatic latent images formed on the peripheral surface of the photosensitive member 1 are developed with a toner through a developing means 5. Then, the toner developed images thus formed are successively transferred onto a transfer material 7 fed to the part between the photosensitive member 1 and the transfer means 6 in such a manner as synchronized with the rotation of the photosensitive member 1.

The transfer material 7 with the toner images transferred thereon is separated from the photosensitive member surface and is led into an image fixing means 8 where the toner images are fixed, then is put out of the apparatus as a duplicate (a copy).

The surface of the photosensitive member 1 is subjected to removal of transfer residual toner through a cleaning means 9 and is cleaned. It is further subjected to charge elimination by pre-exposure light 10 emitted from a pre-exposure means (not shown), and thereafter repeatedly used for image formation. Where the primary charging means 3 is a contact charging means using a charging roller, the pre-exposure is not necessarily required.

-Process Cartridge of the Invention-

The process cartridge of the present invention is constituted by integrally combining some components of constituents such as the above photosensitive member 1, primary charging means 3, developing means 5 and cleaning means 9. This process cartridge may be set to be detachably mountable to the main body of an image forming apparatus such as a copying machine or a laser beam printer. For example, in the process cartridge of the present invention, the photosensitive member 1 may integrally be supported together with the primary charging means 3 to form a cartridge to make up a process cartridge 11 that is detachably mountable to the main body of the apparatus through a guide means such as rails 12 provided in the main body of the apparatus.

EXAMPLES

The present invention is described below in greater detail by giving Examples. In the following Examples, "part(s)" refers to "part(s) by mass".

Example 1

An aluminum cylinder of 260.5 mm in length and 30 mm in diameter which was obtained by hot extrusion in an environment of 23° C./60% RH (an ED pipe made of an aluminum alloy, defined in JIS as a material code A 3003; available from Showa Aluminum Corporation) was used as a support. The Rz jis of the support surface was measured in the area of 100 to 150 mm from the end of the support and found to be 0.8 μm.

In the present invention, the Rz jis was measured according to JIS B 0601(1994) by using a surface profile analyzer SURFCORDER SE3500, manufactured by Kosaka Laboratory Ltd., and setting a feed rate at 0.1 mm/s, a cut-off λc at 0.8 mm, and a measurement length at 2.50 mm. The undermentioned measurement of Rz jis also was carried out under the same conditions as the above.

Next, 7.90 parts of oxygen deficient $SnO_2$ coated $TiO_2$ particles (powder resistivity: 80 Ωcm; coating rate of $SnO_2$ in mass percentage: 20%) as conductive particles, 2.63 parts of a monomer having the following structure, which is a raw material for a phenolic resin as a binder resin, and 8.60 parts of methoxypropanol as a solvent were dispersed for 3 hours by means of a sand mill using glass beads of 1 mm in diameter to prepare a dispersion.

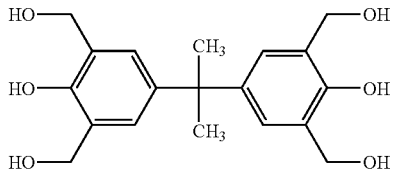

The oxygen deficient $SnO_2$ coated $TiO_2$ particles in this dispersion were in an average particle diameter of 0.45 μm.

To this dispersion, 0.5 part of silicone resin particles (trade name: TOSPEARL 120; available from GE Toshiba Silicones; average particle diameter: 2 μm) as an irregular reflection material and 0.001 part of silicone oil (trade name: SH28PA; available from Dow Corning Toray Silicone Co., Ltd.) as a leveling agent were added, followed by stirring to prepare a reflecting layer coating fluid.

This reflecting layer coating fluid was applied by dip-coating on the support in an environment of 23° C./60% RH, followed by drying and heat curing at 150° C. for 1 hour to form a reflecting layer having a layer thickness of 8 μm in the area of 100 to 150 mm from the end of the support. The Rz jis of the reflecting layer surface was measured in the area of 100 to 150 mm from the end of the support and found to be 1.5 μm.

Separately, this reflecting layer coating fluid was applied on an aluminum sheet in a layer thickness of 8 μm by using Meyer bar, followed by drying to prepare a reflectance measuring sample. The total reflectance of this sample is 54.1% at a wavelength of 405 nm with respect to a standard white board. The specular reflectance of this sample was 3.5% at the wavelength of 405 nm in respect of parallel light whose incident angle was 20 degrees with respect to a normal line of the sample surface.

In addition, 2.63 parts of the monomer having the above structure was dissolved in 8.60 parts of methoxypropanol as a solvent. The solution obtained was applied on a PET film by using Meyer bar, followed by drying and heat curing at 150° C. for 1 hour to prepare a binder resin yellowness index measuring sample having a layer thickness of 10 μm.

The binder resin yellowness index of this sample was measured with SPECTROLINO, manufactured by Gretag-Macbeth Holding Ag, and found to be 4.1.

Next, on the reflecting layer, an intermediate layer coating fluid obtained by dissolving 4 parts of N-methoxymethylated nylon (trade name: TORESIN EF-30T; available from Teikoku Chemical Industry Co., Ltd.) and 2 parts of copolymer nylon resin (trade name: AMILAN CM8000; available from Toray Industries, Inc.) in a mixed solvent of 65 parts of methanol and 30 parts of n-butanol was applied by dip-coating, followed by drying at 100° C. for 10 minutes to form an intermediate layer. The layer thickness in the area of 100 to 150 mm from the end of the support was 0.5 μm.

Next, 10 parts of hydroxygallium phthalocyanine with a crystal form having strong peaks at Bragg angles (2θ±0.2°) of 7.5°, 9.9°, 16.3°, 18.6°, 25.1° and 28.3° in CuKα characteristic X-ray diffraction, 5 parts of polyvinyl butyral (trade name: S-LEC BX-1, available from Sekisui Chemical Co., Ltd.) and 250 parts of cyclohexanone were dispersed for 1 hour by means of a sand mill using glass beads of 1 mm in diameter, and then 250 parts of ethyl acetate was added to prepare a charge generation layer coating fluid.

This charge generation layer coating fluid was applied by dip-coating on the intermediate layer, followed by drying at 100° C. for 10 minutes to form a charge generation layer. The layer thickness in the area of 100 to 150 mm from the end of the support was 0.16 μm.

Separately, this charge generation layer coating fluid was applied on a PET film by using Meyer bar, followed by drying at 100° C. for 10 minutes to prepare an absorbance measuring sample having a layer thickness of 0.16 μm. The absorbance of this sample is 0.21 at the wavelength of 405 nm.

Next, 10 parts of an amine compound having a structure represented by the following formula and 10 parts of polycarbonate resin (trade name: Z400; available from Mitsubishi Engineering-Plastics Corporation) were dissolved in a mixed solvent of 30 parts of dimethoxymethane and 70 parts of chlorobenzene to prepare a charge transport layer coating solution.

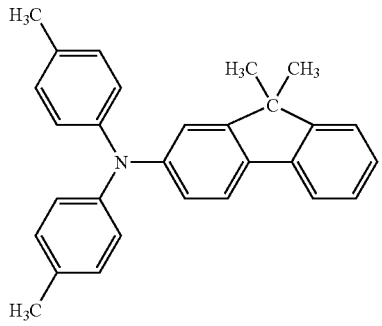

This charge transport layer coating solution was applied by dip-coating on the charge generation layer, followed by hot-air drying at 120° C. for 30 minutes to form a charge transport layer. The layer thickness in the area of 100 to 150 mm from the end of the support was 17 μm.

Separately, this charge transport layer coating fluid was applied on a PET film in a layer thickness of 17 μm by using Meyer bar, followed by drying to prepare an absorbance measuring sample. The absorbance of this sample was 0.046 at the wavelength of 405 nm.

Thus, an electrophotographic photosensitive member whose surface layer was the charge transport layer was produced. The electrophotographic photosensitive member thus produced was set in a laser beam printer (LBP-2510) manufactured by CANON INC. in which the optical system was altered so that the exposure means was changed to a semiconductor laser having the lasing wavelength of 405 nm to reduce the beam spot diameter, and the power source of the pre-exposure unit was kept switched off.

Using this laser beam printer, 3,000-sheet image reproduction test was conducted in an environment of 15° C./10% RH under such conditions as shown below. At the initial stage and after the completion of the 3,000-sheet image reproduction, images formed were evaluated and the surface potential of the electrophotographic photosensitive member was measured. These results are shown in Table 3 (Example 1).

Figure 4:
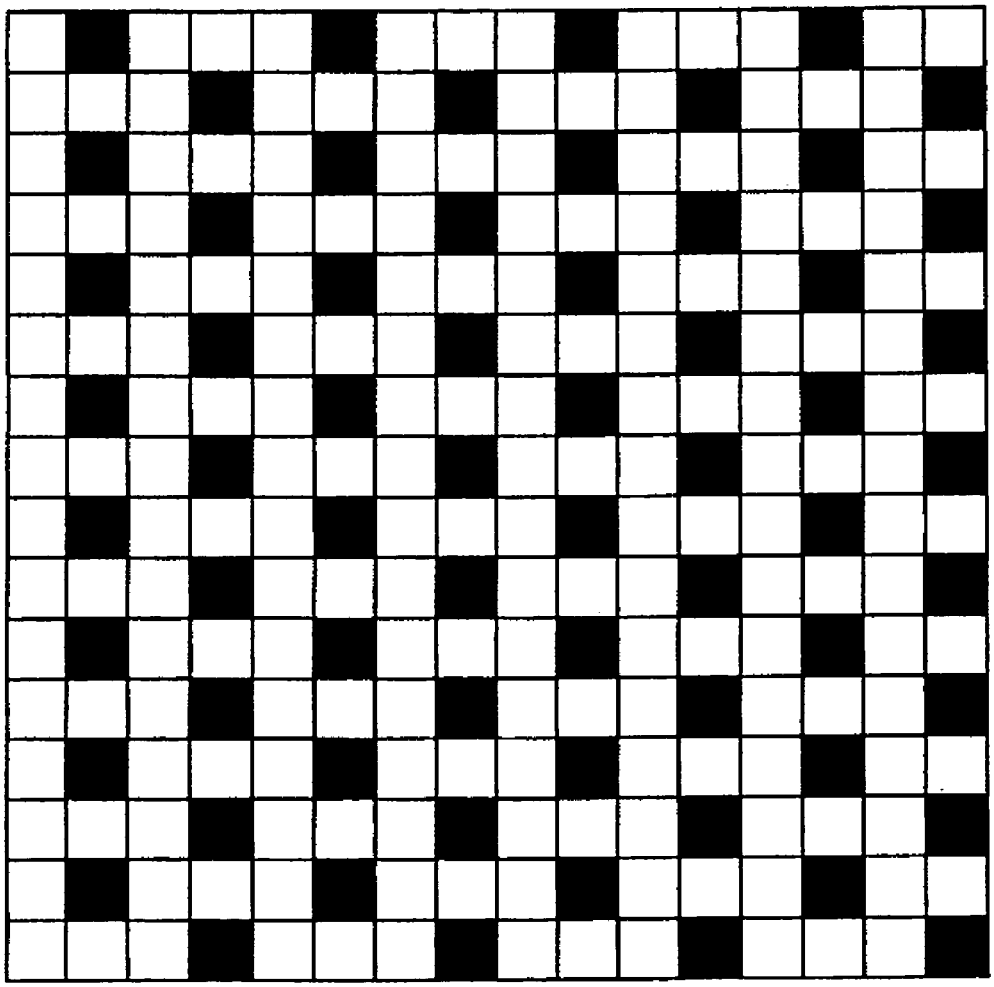
FIG. 4 is a chart for illustrating a knight's move pattern used for printing halftone images.

1. The electrophotographic photosensitive member was set in a cyan color process cartridge of the LBP-2510 and this process cartridge was fitted in a cyan process cartridge station to make evaluation.
2. Full-color printing was operated in an intermittent mode in which a sheet of letter paper on which character images with a print percentage of 2% for each color were formed was put out at intervals of 20 seconds, reproducing images on 3,000 sheets.
3. Four kinds of sample images for image evaluation (a solid white image, a ghost test chart, a solid black image, and a halftone image as shown in FIG. 4 which is a knight's move pattern composed of dots arranged in a knight's move manner) were reproduced at the start of evaluation and after the completion of the 3,000-sheet image reproduction. The ghost test chart refers to a chart in which four solid-black squares 25 mm on each side are arranged on a solid-white background at regular intervals and in parallel with the upper end of the paper, within a range of 30 mm from the position at which images begin to be printed (at 10 mm from the upper end of the paper) and the knight's move pattern halftone image as shown in FIG. 4 is located 30 mm downward from the position at which images begin to be printed.

Criteria of the image evaluation are as shown below.

Evaluation on ghost images:

In observing the ghost test chart;

A: no ghosts are seen at all;

B: ghosts are hardly seen;

C: ghosts are slightly seen;

D: ghosts are seen; and

E: ghosts are clearly seen.

Occurrence of interference fringes:

In observing the knight's move pattern halftone image;

A: no interference fringes are seen at all;

B: interference fringes are slightly seen; and

C: interference fringes are seen.

After the sample images for image evaluation were reproduced, the electrophotographic photosensitive member was set in an apparatus for measuring the surface potential of the electrophotographic photosensitive member (an apparatus in which a probe for measuring the surface potential of the electrophotographic photosensitive member was fitted at the position at which the developing roller of the process cartridge was set (the toner, the developing roller and members involved therewith, and the cleaning blade were removed or detached)), and light-area potential was measured in the state the electrostatic transfer belt unit of the LBP-2510 was detached, and judgement was made on latent-image contrast. Criteria of the image evaluation are as shown below.

AA: Surface potential after image exposure is −200 V or more.

A: Surface potential after image exposure is from −201 V to −225 V.

B: Surface potential after image exposure is from −226 V to −250 V.

C: Surface potential after image exposure is less than −250 V.

Example 2

The procedure in Example 1 was repeated to produce the support and to form thereon the reflecting layer and the intermediate layer. Further, 10 parts of Exemplary Compound (2-1) and 5 parts of polyvinyl benzal resin were added to 250 parts of tetrahydrofuran, and dispersed for 3 hours by means of a sand mill using glass beads of 1 mm in diameter. To the resulting dispersion, 250 parts of cyclohexanone and 250 parts of tetrahydrofuran were added for dilution to prepare a charge generation layer coating fluid. This charge generation layer coating fluid was applied by dip-coating on the intermediate layer, followed by drying at 100° C. for 10 minutes to form a charge generation layer. The layer thickness in the area of 100 to 150 mm from the end of the support was 0.16 μm.

Separately, this charge generation layer coating fluid was applied on a PET film by using Meyer bar, followed by drying to form a film of 0.16 μm in layer thickness to prepare an absorbance measuring sample. The absorbance of this sample was 0.16 at the wavelength of 405 nm.

Next, a charge transport layer was formed in the same manner as in Example 1. Using the electrophotographic photosensitive member thus produced, images were evaluated and potential was measured, in the same way as in Example 1. These results are shown in Table 3 (Example 2).

Example 3

An electrophotographic photosensitive member was produced in the same manner as in Example 1 except that in Example 1 the following points were changed.

The conductive particles of the reflecting layer were changed to 8.08 parts of oxygen deficient $SnO_2$ coated $TiO_2$ particles (powder resistivity: 40 Ωcm; coating rate of $SnO_2$ in mass percentage: 20%), and the amount of the phenol monomer for the phenolic resin as a binder resin of the reflecting layer was changed to 2.02 parts. The oxygen deficient $SnO_2$ coated $TiO_2$ particles were in an average particle diameter of 0.46 μm. As a result, the total reflectance of the reflecting layer was 45.8% at the wavelength of 405 nm with respect to a standard white board, and the specular reflectance of the reflecting layer was 3.2% at the wavelength of 405 nm in respect of parallel light whose incident angle was 20 degrees with respect to the normal line of the reflecting layer surface.

Using the electrophotographic photosensitive member thus produced, images were evaluated and potential was measured, in the same way as in Example 1. These results are shown in Table 3 (Example 3).

Examples 4 to 6

Electrophotographic photosensitive members were produced in the same manner as in Examples 1 to 3 except that in Examples 1 to 3 the binder resin of each reflecting layer was changed to resol type phenolic resin (trade name: PL-4852) available from Gun-ei Chemical Industry Co., Ltd. (Examples 4, 5 and 6 correspond to Examples 1, 2 and 3, respectively).

Using the electrophotographic photosensitive members thus produced, images were evaluated and potential was measured, in the same way as in Example 1. These results are shown in Table 3 (Examples 4 to 6).

Examples 7 to 9

Electrophotographic photosensitive members were produced in the same manner as in Examples 1 to 3 except that in Examples 1 to 3 the binder resin of each reflecting layer was changed to phenyl silicone resin (trade name: SH840) available from Dow Corning Toray Silicone Co., Ltd. (Examples 7, 8 and 9 correspond to Examples 1, 2 and 3, respectively).

Using the electrophotographic photosensitive members thus produced, images were evaluated and potential was measured, in the same way as in Example 1. These results are shown in Table 3 (Examples 7 to 9).

Example 10

An electrophotographic photosensitive member was produced in the same manner as in Example 1 except that in Example 1 the following points were changed in regard to the formation of the reflecting layer.

4.9 parts of oxygen deficient $SnO_2$ coated $TiO_2$ particles (powder resistivity: 80 Ωcm; coating rate of $SnO_2$ in mass percentage: 20%) as conductive particles, 1.23 parts of resol type phenolic resin (trade name: PL-4852) available from Gun-ei Chemical Industry Co., Ltd. as a binder resin and 8.60 parts of methoxypropanol as a solvent were dispersed for 3 hours by means of a sand mill using glass beads of 1 mm in diameter to prepare a dispersion.

To this dispersion, 0.12 part of silicone resin particles (trade name: TOSPEARL 120; available from GE Toshiba Silicones; average particle diameter: 2 μm) as an irregular reflection material and 0.001 part of silicone oil (trade name: SH28PA; available from Dow Corning Toray Silicone Co., Ltd.) as a leveling agent were added, followed by stirring to prepare a reflecting layer coating fluid.

This reflecting layer coating fluid was applied by dip-coating on the support in an environment of 23° C./60% RH, followed by drying and heat curing at 140° C. for 30 minutes to form a reflecting layer having a layer thickness of 5 μm in the area of 100 to 150 mm from the end of the support.

In addition, 10 parts of the binder resin used for this reflecting layer (the resol type phenolic resin available from Gun-ei Chemical Industry Co., Ltd.; trade name: PL-4852) was dissolved in 10 parts of methoxypropanol as a solvent. The solution obtained was applied on a PET film by using Meyer bar, followed by drying and heat curing at 140° C. for 30 minutes to prepare a binder resin yellowness index measuring sample having a layer thickness of 10 μm. The binder resin yellowness index of this sample was measured with SPECTROLINO, manufactured by Gretag-Macbeth Holding Ag, and found to be 13.7.

Using the electrophotographic photosensitive member thus produced, images were evaluated and potential was measured, in the same way as in Example 1. These results are shown in Table 3 (Example 10).

Example 11

An electrophotographic photosensitive member was produced in the same manner as in Example 1 except that in Example 1 the following points were changed in regard to the production of the support and the layer thickness of the reflecting layer.

The support was changed to the following cut pipe.

An aluminum unprocessed pipe (made of an aluminum alloy defined in JIS H 4000:1999 as a material code A 6063) of 30.5 mm in outer diameter, 28.5 mm in inner diameter, 260.5 mm in length, 100 μm in run-out precision and 10 μm in Rz jis, which was obtained by hot extrusion, was set on a lathe, and was cut with a diamond sintered turning tool to produce a cut pipe of 30.0±0.02 mm in outer diameter, 15 μm in run-out precision and 0.2 μm in Rz jis.

In the cutting, the number of main-shaft revolutions was 3,000 rpm, the feed rate of the turning tool was 0.3 mm/rev and the cutting time was 24 seconds exclusive of time taken for attaching and detaching the object to be subjected to cutting.

The layer thickness of the reflecting layer was changed to 6 μm (measured in the area of 100 to 150 mm from the end of the support).

Using the electrophotographic photosensitive member thus produced, images were evaluated and potential was measured, in the same way as in Example 1. These results are shown in Table 3 (Example 11).

Example 12

An electrophotographic photosensitive member was produced in the same manner as in Example 1 except that in Example 1 the following points were changed in regard to the production of the support and the layer thickness of the reflecting layer.

A cylinder made of an aluminum alloy defined in JIS H 4000:1999 as a material code A 3003, was subjected to wet-process honing under the following conditions (using a wet-process honing machine manufactured by Fujiseiki Corporation) so that the Rz jis of its surface was adjusted to 2.0 μm.

-Honing Conditions-

Abrasive grains: Spherical aluminum beads of 30 μm in average particle diameter (trade name: CB-A30S; available from Showa Denko K.K.).

Suspension medium: Water.

Abrasive grains/suspension medium: 1/9 (volume ratio).

Number of revolutions of aluminum cylinder: 1.67 $s^{-1}$.

Air spray pressure: 0.165 MPa.

Gun movement speed: 13.3 mm/s.

Distance between gun nozzle and aluminum cylinder: 180 mm.

Ejection angle of abrasive grains: 45 degrees.

Number of times of projecting abrasive fluid (abrasive grains and suspension medium): Once.

The layer thickness of the reflecting layer was changed to 4 μm (measured in the area of 100 to 150 mm from the end of the support).

Using the electrophotographic photosensitive member thus produced, images were evaluated and potential was measured, both in the same way as in Example 1. These results are shown in Table 3 (Example 12).

Example 13

The procedure in Example 1 was repeated to produce the support and to form thereon the reflecting layer, the intermediate layer and the charge generation layer.

Next, 10 parts of an amine compound having a structure represented by the following formula and 10 parts of polycarbonate resin (trade name: Z400; available from Mitsubishi Engineering-Plastics Corporation) were dissolved in a mixed solvent of 30 parts of dimethoxymethane and 70 parts of chlorobenzene to prepare a charge transport layer coating solution.

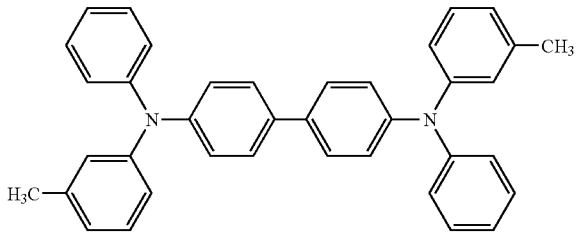

This charge transport layer coating solution was applied by dip-coating on the charge generation layer, followed by hot-air drying at 120° C. for 30 minutes to form a charge transport layer. The layer thickness in the area of 100 to 150 mm from the end of the support was 17 μm.

Separately, this charge transport layer coating fluid was applied on a PET film in a layer thickness of 17 μm by using Meyer bar, followed by drying to prepare an absorbance measuring sample. The absorbance of this sample was 0.061 at the wavelength of 405 nm.

Using the electrophotographic photosensitive member thus produced, images were evaluated and potential was measured, in the same way as in Example 1. These results are shown in Table 3 (Example 13).

Example 14

The procedure in Example 11 was repeated to form on the support the reflecting layer, the intermediate layer, the charge generation layer and the charge transport layer, provided that the layer thickness of the charge transport layer was changed from 17 μm to 14 μm.

Separately, the charge transport layer coating fluid used in this Example 14 was applied on a PET film in a layer thickness of 14 μm by using Meyer bar, followed by drying to prepare an absorbance measuring sample. The absorbance of this sample was 0.038 at the wavelength of 405 nm.

Next, 45 parts of a compound having a structure represented by the following formula (a charge transporting material having an acrylic group which is a chain-polymerizable functional group):

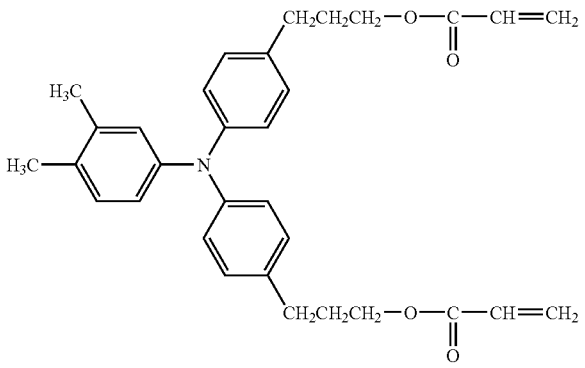

10 parts of polytetrafluoroethylene particles (trade name: LUBRON L-2; available from Daikin Industries, Ltd.) and 55 parts of n-propanol were dispersed and mixed by means of an ultra high pressure dispersion machine to prepare a protective layer coating dispersion.

This protective layer coating dispersion was applied by dip-coating on the charge transport layer, and the wet coating formed was dried at 50° C. for 5 minutes. Thereafter, the dried coating was irradiated with electron rays under the conditions of an accelerating voltage of 150 kV and a dose of 1.5 Mrad to be cured, thereby forming a protective layer (a second charge transport layer) with a layer thickness of 4 μm. Subsequently, heat treatment was carried out for 3 minutes on the condition that the protective layer was heated to 120° C. The oxygen concentration during the irradiation with electron rays and the heat treatment for 3 minutes was 20 ppm.

Next, in the atmosphere, heat treatment was carried out for 1 hour on the condition that the protective layer was heated to 100° C., to produce an electrophotographic photosensitive member the protective layer of which was a surface layer.

Using the electrophotographic photosensitive member thus produced, images were evaluated and potential was measured, in the same way as in Example 1. These results are shown in Table 3 (Example 14).

Example 15

An electrophotographic photosensitive member was produced in the same manner as in Example 11 except that the following points were changed in the formation of the reflecting layer.

7.90 parts of oxygen deficient $SnO_2$ coated $TiO_2$ particles (powder resistivity: 80 Ωcm; coating rate of $SnO_2$ in mass percentage: 20%) as conductive particles, 3.3 parts of acrylic melamine resin (trade name: ACROSE #6000; available from Dai Nippon Toryo Co., Ltd.; resin solid content: 60%) as a binder resin, and 4.3 parts of xylene and 4.3 parts of methoxypropanol as solvents were dispersed for 3 hours by means of a sand mill using glass beads of 1 mm in diameter to prepare a dispersion.

To this dispersion, 0.5 part of silicone resin particles (trade name: TOSPEARL 120; available from GE Toshiba Silicones; average particle diameter: 2 μm) as an irregular reflection material and 0.001 part of silicone oil (trade name: SH28PA; available from Dow Corning Toray Silicone Co., Ltd.) as a leveling agent were added, followed by stirring to prepare a reflecting layer coating fluid.

This reflecting layer coating fluid was applied by dip-coating on the support in an environment of 23° C./60% RH, followed by drying and heat curing at 150° C. for 1 hour to form a reflecting layer having a layer thickness of 6 μm in the area of 100 to 150 mm from the end of the support.

Separately, this reflecting layer coating fluid was applied on an aluminum sheet in a layer thickness of 8 μm by using Meyer bar, followed by drying to prepare a reflectance measuring sample. The total reflectance of this sample was 56.5% at the wavelength of 405 nm with respect to a standard white board. The specular reflectance of this sample was 3.7% at the wavelength of 405 nm.

In addition, 3.3 parts of acrylic melamine resin (trade name: ACROSE #6000; available from Dai Nippon Toryo Co., Ltd.; resin solid content: 60%) as a binder resin was dissolved in a mixture of 4.3 parts of xylene and 4.3 parts of methoxypropanol as solvents. The solution obtained was applied on a PET film by using Meyer bar, followed by drying and heat curing at 150° C. for 1 hour to prepare a binder resin yellowness index measuring sample having a layer thickness of 10 μm.

The binder resin yellowness index of this sample was measured with SPECTROLINO, manufactured by Gretag-Macbeth Holding Ag, and found to be 0.5.

Using the electrophotographic photosensitive member thus produced, images were evaluated and potential was measured, in the same way as in Example 1. These results are shown in Table 3 (Example 15).

Example 16

An electrophotographic photosensitive member was produced in the same manner as in Example 11 except that the binder resin of the reflecting layer was changed to melamine alkyd resin (trade name: DELICON #300; available from Dai Nippon Toryo Co., Ltd.).

Using the electrophotographic photosensitive member thus produced, images were evaluated and potential was measured, in the same way as in Example 1. These results are shown in Table 3 (Example 16).

Example 17

An electrophotographic photosensitive member was produced in the same manner as in Example 1 except that the layer thickness of the charge generation layer was changed to 0.22 μm.

Using the electrophotographic photosensitive member thus produced, images were evaluated and potential was measured, in the same way as in Example 1. These results are shown in Table 3 (Example 17).

Comparative Example 1

An electrophotographic photosensitive member was produced in the same manner as in Example 1 except that the following points were changed in producing the support and forming the reflecting layer.

The support was changed to the cut pipe used in Example 11.

6.6 parts of oxygen deficient $SnO_2$ coated $TiO_2$ particles (powder resistivity: 80 Ωcm; coating rate of $SnO_2$ in mass percentage: 20%) as conductive particles, 3.3 parts of a monomer having the following structure, which is a raw material for a phenolic resin as a binder resin, and 8.60 parts of methoxypropanol as a solvent were dispersed for 3 hours by means of a sand mill using glass beads of 1 mm in diameter to prepare a dispersion.

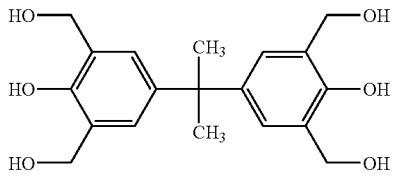

To this dispersion, 0.001 part of silicone oil (trade name: SH28PA; available from Dow Corning Toray Silicone Co., Ltd.) as a leveling agent was added, followed by stirring to prepare a reflecting layer coating fluid.

This reflecting layer coating fluid was applied on the support in an environment of 23° C./60% RH, followed by drying and heat curing at 140° C. for 30 minutes to form a reflecting layer. The layer thickness in the area of 100 to 150 mm from the end of the support was 2 μm.

Using the electrophotographic photosensitive member thus produced, images were evaluated and potential was measured, in the same way as in Example 1. These results are shown in Table 3 (Comparative Example 1).

Comparative Example 2

An electrophotographic photosensitive member was produced in the same manner as in Example 1 except that the following points were changed in producing the support and forming the reflecting layer and the charge generation layer.

The support was changed to the cut pipe used in Example 11.

Next, 6.6 parts of oxygen deficient $SnO_2$ coated barium sulfate particles (powder resistivity: 80 Ωcm; coating rate of $SnO_2$ in mass percentage: 60%) as conductive particles, 3.3 parts of phenolic resin (trade name: PLYOPHEN J-325; available from Dainippon Ink & Chemicals, Incorporated; resin solid content: 60%) as a binder resin and 8.60 parts of methoxypropanol as a solvent were dispersed for 3 hours by means of a sand mill using glass beads of 1 mm in diameter to prepare a dispersion.

To this dispersion, 0.07 part of silicone resin particles (trade name: TOSPEARL 120; available from GE Toshiba Silicones; average particle diameter: 2 μm) as an irregular reflection material and 0.001 part of silicone oil (trade name: SH28PA; available from Dow Corning Toray Silicone Co., Ltd.) as a leveling agent were added, followed by stirring to prepare a reflecting layer coating fluid.

This reflecting layer coating fluid was applied by dip-coating on the support in an environment of 23° C./60% RH, followed by drying and heat curing at 140° C. for 30 minutes to form a reflecting layer. The layer thickness in the area of 100 to 150 mm from the end of the support was 2 μm.

In addition, the binder resin (phenolic resin; trade name: PLYOPHEN J-325; available from Dainippon Ink & Chemicals, Incorporated) used for this reflecting layer was applied on a PET film by using Meyer bar, followed by drying and heat curing at 140° C. for 30 minutes to prepare a binder resin yellowness index measuring sample having a layer thickness of 20 μm. The binder resin yellowness index of this sample was measured with SPECTROLINO, manufactured by Gretag-Macbeth Holding Ag, and found to be 29.5.

As to the charge generation layer, the charge generation layer coating fluid prepared in Example 2 was applied by dip-coating on the intermediate layer, followed by drying at 100° C. for 10 minutes to form the charge generation layer. The layer thickness in the area of 100 to 150 mm from the end of the support was 0.14 μm.

Using the electrophotographic photosensitive member thus produced, images were evaluated and potential was measured, in the same way as in Example 1. These results are shown in Table 3 (Comparative Example 2).

Comparative Example 3

An electrophotographic photosensitive member was produced in the same manner as in Example 1 except that the following points were changed in producing the support and forming the reflecting layer and the charge generation layer.

The support was changed to the cut pipe used in Example 11.

Next, 6.6 parts of oxygen deficient $SnO_2$ coated barium sulfate particles (powder resistivity: 80 Ωcm; coating rate of $SnO_2$ in mass percentage: 60%) as conductive particles, 3.3 parts of phenolic resin (trade name: PLYOPHEN J-325; available from Dainippon Ink & Chemicals, Incorporated; resin solid content: 60%) as a binder resin and 8.60 parts of methoxypropanol as a solvent were subjected to dispersion for 3 hours by means of a sand mill using glass beads of 1 mm in diameter to prepare a dispersion.

To this dispersion, 0.5 part of silicone resin particles (trade name: TOSPEARL 120; available from GE Toshiba Silicones; average particle diameter: 2 μm) as an irregular reflection material and 0.001 part of silicone oil (trade name: SH28PA; available from Dow Corning Toray Silicone Co., Ltd.) as a leveling agent were added, followed by stirring to prepare a reflecting layer coating fluid.

This reflecting layer coating fluid was applied by dip-coating on the support in an environment of 23° C./60% RH, followed by drying and heat curing at 180° C. for 60 minutes to form a reflecting layer. The layer thickness in the area of 100 to 150 mm from the end of the support was 15 μm.

In addition, the binder resin (phenolic resin; trade name: PLYOPHEN J-325; available from Dainippon Ink & Chemicals, Incorporated) used for this reflecting layer was applied on slide glass by using Meyer bar, followed by drying and heat curing at 180° C. for 1 hour to prepare a binder resin yellowness index measuring sample having a layer thickness of 20 μm. The binder resin yellowness index of this sample was measured with SpectroLino, manufactured by Gretag-Macbeth Holding Ag, and found to be 43.5.

As to the charge generation layer, the charge generation layer coating fluid prepared in Example 2 was applied by dip-coating on the intermediate layer, followed by drying at 100° C. for 10 minutes to form the charge generation layer. The layer thickness in the area of 100 to 150 mm from the end of the support was 0.14 μm.

Using the electrophotographic photosensitive member thus produced, images were evaluated and potential was measured, in the same way as in Example 1. These results are shown in Table 3 (Comparative Example 3).

Comparative Example 4

An electrophotographic photosensitive member was produced in the same manner as in Comparative Example 3 except that the following points were changed.

10 parts of hydroxygallium phthalocyanine with a crystal form having strong peaks at Bragg angles (2θ±0.2°) of 7.5°, 9.9°, 16.3°, 18.6°, 25.1° and 28.3° in CuKa characteristic X-ray diffraction, 5 parts of polyvinyl butyral (trade name: S-LEC BX-1, available from Sekisui Chemical Co., Ltd.) and 220 parts of cyclohexanone were dispersed for 1 hour by means of a sand mill using glass beads of 1 mm in diameter, and then 220 parts of ethyl acetate was added to prepare a charge generation layer coating fluid.

This charge generation layer coating fluid was applied by dip-coating on the intermediate layer, followed by drying at 100° C. for 10 minutes to form a charge generation layer. The layer thickness in the area of 100 to 150 mm from the end of the support was 0.32 μm.

Using the electrophotographic photosensitive member thus produced, images were evaluated and potential was measured, in the same way as in Example 1. These results are shown in Table 3 (Comparative Example 4).

Comparative Example 5

An electrophotographic photosensitive member was produced in the same manner as in Comparative Example 1 except that the following points were changed in forming the charge generation layer.

4 parts of titanyl oxyphthalocyanine, 2 parts of polyvinyl butyral (trade name: S-LEC BX-1, available from Sekisui Chemical Co., Ltd.) and 30 parts of cyclohexanone were dispersed for 4 hours by means of a sand mill using glass beads of 1 mm in diameter, and thereafter 50 parts of ethyl acetate was added to prepare a charge generation layer coating fluid. This was applied by dip-coating on the intermediate layer to form a charge generation layer with a layer thickness of 1.12 μm.

Using the electrophotographic photosensitive member thus produced, images were evaluated and potential was measured, in the same way as in Example 1. These results are shown in Table 3 (Comparative Example 5).

Evaluation was made in the same way as in Comparative Example 6 except that the exposure means was changed to a semiconductor laser having a lasing wavelength of 790 nm, and the optical system was changed to one usable for the corresponding wavelength. The results obtained are shown in Table 3 (Reference Example 1).

TABLE 3

| | Reflecting layer | | | Charge generation layer | | Light-area potential | | Judgment on contrast Initial stage/ after running | Ghost image evaluation | |
|---|---|---|---|---|---|---|---|---|---|---|
| | Total reflectance (%) | Specular reflectance (%) | Binder resin yellowness index | Absorbance (Abs.) | Interference fringes | Initial stage (−V) | After running (−V) | | Initial stage | After running |
| Example: | | | | | | | | | | |
| 1 | 54.1 | 3.5 | 4.1 | 0.21 | A | 200 | 230 | AA/B | A | B |
| 2 | 54.1 | 3.5 | 4.1 | 0.16 | A | 190 | 200 | AA/AA | A | B |
| 3 | 45.8 | 3.2 | 4.1 | 0.21 | A | 210 | 235 | A/B | A | A |
| 4 | 51.2 | 3.4 | 13.7 | 0.21 | A | 205 | 235 | A/B | A | B |
| 5 | 51.2 | 3.4 | 13.7 | 0.16 | A | 195 | 205 | AA/B | A | B |
| 6 | 43.4 | 3.1 | 13.7 | 0.21 | A | 215 | 240 | A/B | A | A |
| 7 | 56.9 | 3.6 | 0.3 | 0.21 | A | 195 | 225 | AA/B | A | B |
| 8 | 56.9 | 3.6 | 0.3 | 0.16 | A | 185 | 195 | AA/AA | A | B |
| 9 | 48.2 | 3.3 | 0.3 | 0.21 | A | 205 | 230 | A/B | A | A |
| 10 | 53.7 | 7.8 | 13.7 | 0.21 | A | 205 | 235 | A/B | A | B |
| 11 | 58.2 | 3.8 | 4.1 | 0.21 | A | 200 | 230 | AA/B | A | B |
| 12 | 57.3 | 3.1 | 4.1 | 0.21 | A | 200 | 230 | AA/B | A | B |
| 13 | 54.1 | 3.5 | 4.1 | 0.21 | A | 220 | 250 | B/B | A | B |
| 14 | 58.2 | 3.8 | 4.1 | 0.21 | A | 190 | 225 | AA/A | B | B |
| 15 | 56.5 | 3.7 | 0.5 | 0.21 | A | 205 | 230 | A/B | B | C |
| 16 | 56.7 | 3.6 | 0.6 | 0.21 | A | 210 | 235 | A/B | B | C |
| 17 | 54.1 | 3.5 | 4.1 | 0.29 | A | 170 | 205 | AA/A | B | C |
| Comparative Example: | | | | | | | | | | |
| 1 | 75 | 20 | 4.1 | 0.21 | C | 205 | 245 | A/B | * | * |
| 2 | 45 | 15 | 29.5 | 0.14 | B | 245 | 265 | B/C | A | A |
| 3 | 12 | 2.2 | 43.5 | 0.14 | A | 275 | 300 | C/C | A | C |

TABLE 3-continued

| | Reflecting layer | | | Charge generation layer | | Light-area potential | | Judgment on contrast | Ghost image evaluation | |
|---|---|---|---|---|---|---|---|---|---|---|
| | Total reflectance (%) | Specular reflectance (%) | Binder resin yellowness index | Absorbance (Abs.) | Interference fringes | Initial stage (−V) | After running (−V) | Initial stage/ after running | Initial stage | After running |
| 4 | 12 | 2.2 | 43.5 | 0.42 | A | 150 | 180 | AA/AA | C | D |
| 5 | 75 | 20 | 4.1 | 1.12 | A | 295 | 380 | C/C | D | D |
| Reference Example: | | | | | | | | | | |
| 1 | 45 | 15 | 29.5 | 0.21 | A | 180 | 200 | AA/AA | B | C |

*Interference fringes seriously appear and fair evaluation is unable.

This application claims priority from Japanese Patent Application No. 2005-111828 filed Apr. 8, 2005, which is hereby incorporated by reference herein.

What is claimed is:

1. An electrophotographic apparatus comprising an electrophotographic photosensitive member, a charging means, an image exposure means, a developing means and a transfer means, wherein a semiconductor laser having an emission wavelength of from 380 nm to 500 nm is used as the image exposure means; and an electrophotographic photosensitive member having a support, and at least a reflecting layer having conductivity, a charge generation layer and a charge transport layer provided on the support is used as the electrophotographic photosensitive member, where the reflecting layer (i) has a total reflectance of 30% or more with respect to a standard white board at said emission wavelength and a specular reflectance of less than 15% at said emission wavelength and (ii) contains a binder resin, wherein a layer 10 μm in thickness composed of the binder resin has a yellowness index of 15 or less as calculated according to ASTM D1925, and the charge generation layer has an absorbance of 1.0 or less at said emission wavelength.

2. The electrophotographic apparatus according to claim 1, wherein said binder resin is an organosilicon polymer.

3. The electrophotographic apparatus according to claim 1, wherein said binder resin is a cured product of a phenolic compound represented by the following general formula (1):

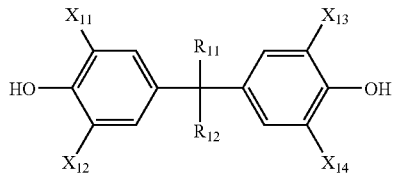

(1)

wherein $R_{11}$ and $R_{12}$ are each independently a hydrogen atom, a substituted or unsubstituted alkyl group or a substituted or unsubstituted phenyl group; and $X_{11}$ to $X_{14}$ are each independently a hydrogen atom, a hydroxymethyl group or a methyl group, provided that at least one of $X_{11}$ to $X_{14}$ is a hydroxymethyl group.

4. The electrophotographic apparatus according to claim 1, wherein said charge generation layer contains a hydroxy gallium phthalocyanine compound.

5. The electrophotographic apparatus according to claim 1, wherein said charge generation layer contains an azo compound represented by the following general formula (2):

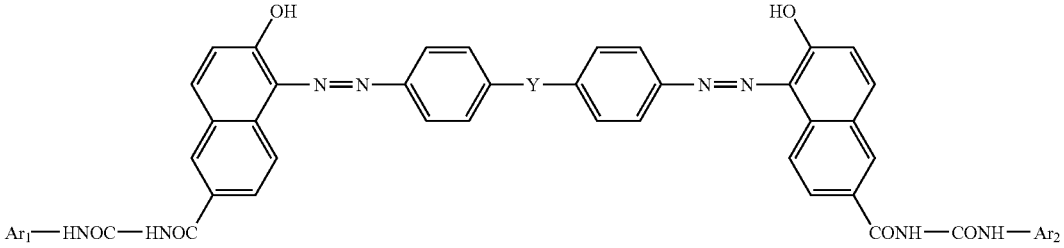

(2)

wherein $Ar_1$ and $Ar_2$ are each independently an aryl group which may have a substituent, and Y is a ketone group or a group represented by the following general formula (3) or the following general formula (4):

(3)

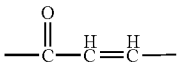

(4)

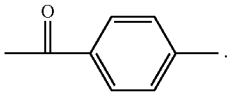

6. The electrophotographic apparatus according to claim 1, wherein said charge transport layer has an absorbance of 0.05 or less at said emission wavelength.

7. The electrophotographic apparatus according to claim 1, wherein said charge generation layer has an absorbance of 0.30 or less at said emission wavelength.

* * * * *

UNITED STATES PATENT AND TRADEMARK OFFICE

CERTIFICATE OF CORRECTION

PATENT NO. : 7,333,752 B2
APPLICATION NO. : 11/481840
DATED : February 19, 2008
INVENTOR(S) : Masataka Kawahara et al.

It is certified that error appears in the above-identified patent and that said Letters Patent is hereby corrected as shown below:

ON THE TITLE PAGE [56] REFERENCES CITED:

Foreign Patent Documents,
"01/169453 should read --01-169543
03/146958 03-146958
08/062879" 08-062879--.

COLUMN 8:

Line 36, "$R^{21}_{r}SiO_{(4-rs/2}(OR^{22})_{s}$" should read --$R^{21}_{r}SiO_{(4-r-s/2}(OR^{22})_{s}$--.

COLUMN 9:

Line 40, "$R^{31}_{a}SiY_{i-n}$" should read --$R^{31}_{a}SiY_{4-a}$--.

COLUMN 29:

Line 18, "CuKa" should read --CuKα--.

COLUMN 30:

Line 23, "Example 5)." should read --Example 5). ¶ Reference Example 1--.

UNITED STATES PATENT AND TRADEMARK OFFICE

CERTIFICATE OF CORRECTION

PATENT NO. : 7,333,752 B2
APPLICATION NO. : 11/481840
DATED : February 19, 2008
INVENTOR(S) : Masataka Kawahara et al.

It is certified that error appears in the above-identified patent and that said Letters Patent is hereby corrected as shown below:

COLUMN 32:

Line 41, "hydroxy" should read --hydroxy- --.

Signed and Sealed this

Seventh Day of April, 2009

JOHN DOLL
*Acting Director of the United States Patent and Trademark Office*